US006870117B1

(12) United States Patent
Huang

(10) Patent No.: US 6,870,117 B1
(45) Date of Patent: Mar. 22, 2005

(54) FIXTURE FOR A PUSHBUTTON SWITCH

(76) Inventor: Albert Huang, 3F, No. 146, Sec. 4 Chungking N. Rd., Taipei (TW)

( * ) Notice: Subject to any disclaimer, the term of this patent is extended or adjusted under 35 U.S.C. 154(b) by 0 days.

(21) Appl. No.: 10/853,176

(22) Filed: May 26, 2004

(51) Int. Cl.[7] ..... H01H 9/00

(52) U.S. Cl. ..... 200/553; 200/339; 200/284

(58) Field of Search ..... 200/6 R–6 BB, 200/553, 557–563, 284, 293, 329, 339

(56) References Cited

U.S. PATENT DOCUMENTS 4,340,791 A * 7/1982 Sorenson ..... 200/302.3
4,874,911 A * 10/1989 Parrish ..... 200/6 R
5,064,977 A * 11/1991 Fierro ..... 200/293
6,323,450 B1 * 11/2001 Chen ..... 200/553
6,753,491 B1 * 6/2004 Huang ..... 200/400

* cited by examiner

*Primary Examiner*—Michael A. Friedhofer
(74) *Attorney, Agent, or Firm*—Fei-Fei Chao; Bingham McCutchen LLP

(57) ABSTRACT

A pushbutton switch includes a hollow housing with a pushbutton pivotally mounted on a top face of the hollow housing and an open end and a seat received in the hollow housing from the open end of the hollow housing. The seat has two first receiving spaces and two second receiving spaces. Two first terminals each have a first terminal plate extending from a bottom face of the seat and a first engaging plate orthogonally extending from a distal end of the first terminal plate and received in a corresponding one of the first receiving spaces laterally. Two second terminals each have a second terminal plate extending from the bottom face of the seat and a second engaging plate orthogonally extending from a distal end of the second terminal plate and received in a corresponding one of the second receiving spaces laterally.

4 Claims, 6 Drawing Sheets

FIXTURE FOR A PUSHBUTTON SWITCH

BACKGROUND OF THE INVENTION

1. Field of the Invention

The present invention relates to a fixture for a pushbutton switch, and more particularly to the terminal fixture which is able to maintain the housing of the pushbutton switch intact without any damage occurring during assembly.

2. Description of Related Art

Conventional pushbutton switches have terminals for connection with a power source. One conventional pushbutton switch is shown in FIG. 6, which has terminals (6) extending out from a bottom of a housing (5). During the assembly of the conventional pushbutton switch, the terminals (6) are forced fitted into the housing (5) by an auxiliary tool. By using the auxiliary tool, the housing (5) may be damaged and thus the manufacture cost is high. Furthermore, a lot of manual labor is required to force fit the terminals (6) into the housing (5), which is also another factor to make the cost high.

Furthermore, with reference to FIG. 7, it is noted that the indicating lamp (7) beneath the pushbutton (5) is laid horizontally. Because the light from the indicating lamp (7) scatters during the day time, the observer can not easily check whether the pushbutton is properly pressed.

To overcome the shortcomings, the present invention tends to provide an improved pushbutton switch fixture to mitigate the aforementioned problems.

SUMMARY OF THE INVENTION

The primary objective of the present invention is to provide an improved fixture for a pushbutton switch, which laterally slides in the terminals in respective receiving, spaces defined in a terminal seat such that no auxiliary tool is required and thus damage to the housing is minimized.

Other objects, advantages and novel features of the invention will become more apparent from the following detailed description when taken in conjunction with the accompanying drawings.

DETAILED DESCRIPTION OF THE PREFERRED EMBODIMENT

Figure 1:
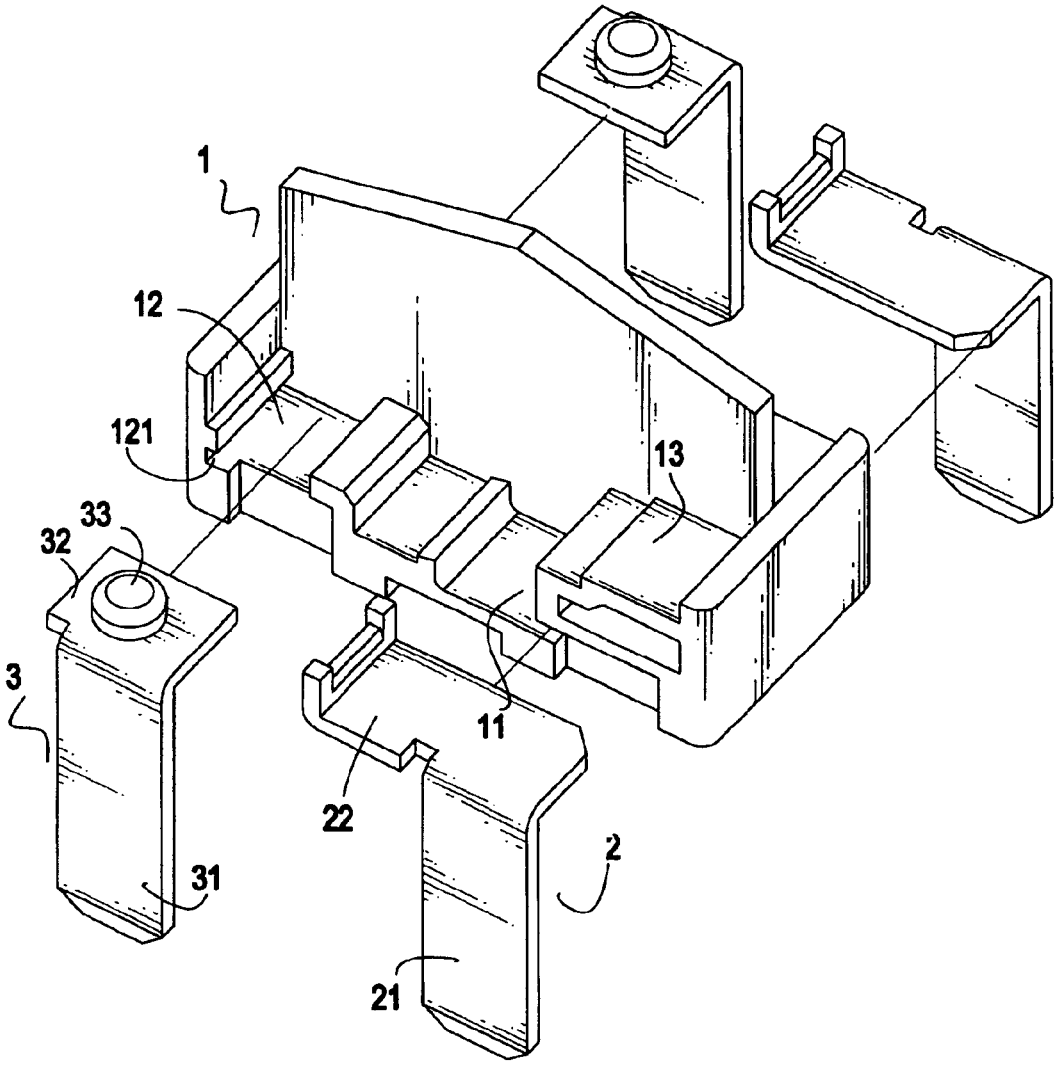
FIG. 1 is an exploded perspective view showing the elements of the pushbutton switch of the present invention.

With reference to FIG. 1, the pushbutton switch in accordance with the present invention has a seat (1), two pairs of first terminals (2) and two pairs of second terminals (3).

The seat (1) is provided with two first receiving spaces (11) respectively defined in opposite sides of the seat (1) and two second receiving spaces (12) also respectively defined in opposite sides of the seat (1). A pressing plate (13) is formed with the seat (1) and extending on top of the first receiving space (11). A receiving track (121) is defined in two opposite sides defining the second receiving space (12) and communicated with the second receiving space (12).

Each of the first terminals (2) has a first terminal plate (21) and a first engaging plate (22) orthogonally extending out from a distal end of the first terminal plate (21) to correspond to and be received in the first receiving space (11).

Each of the second terminals (3) has a second terminal plate (31) and a second engaging plate (32) orthogonally extending out from a distal end of the second terminal plate (31) to correspond to and be received in the second receiving space (12). A contact (33) is formed on a top face of the second engaging plate (32).

Figure 2:
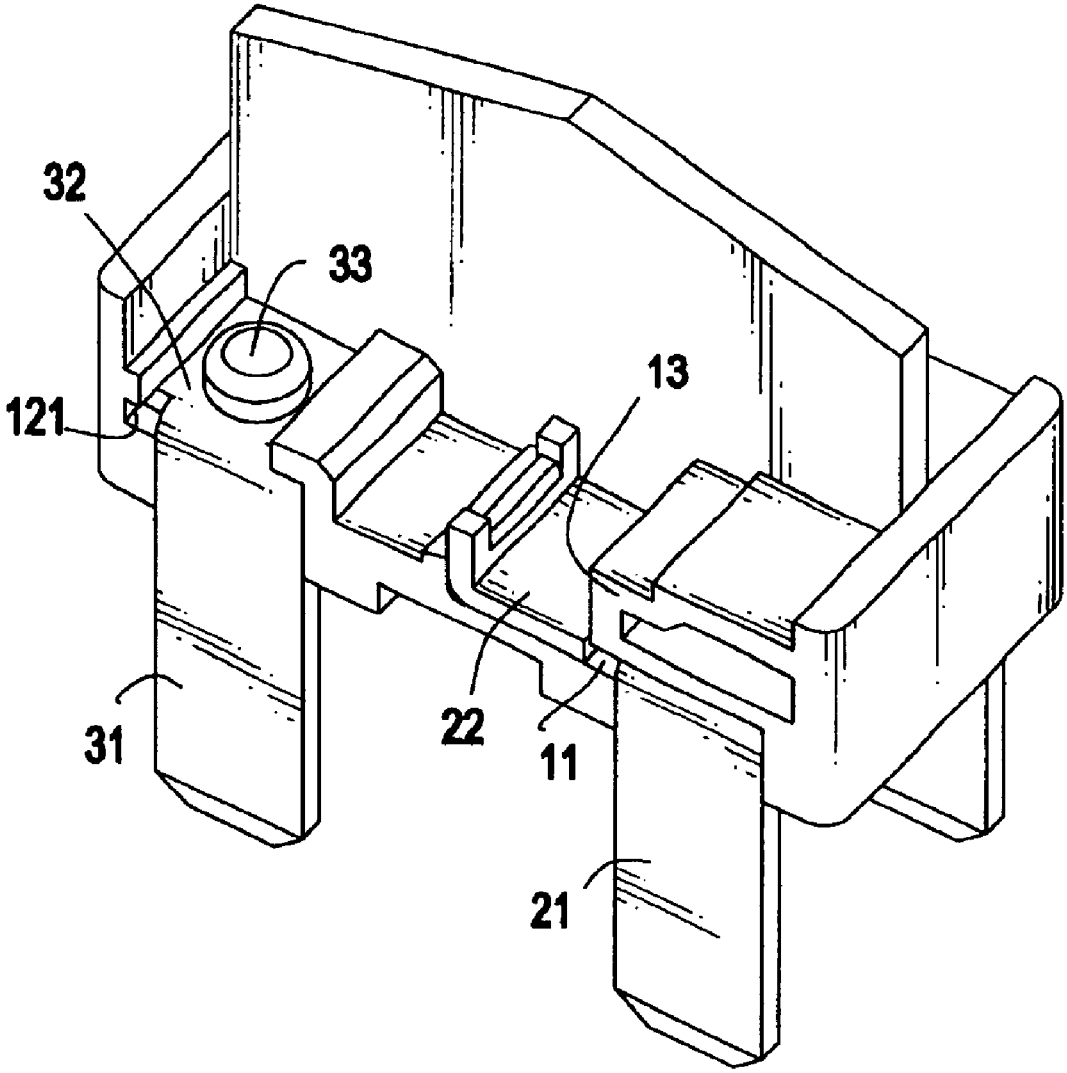
FIG. 2 is a perspective view of the assembly of a seat and terminals.

With reference to FIG. 2, during assembly, it is noted that the first engaging plate (22) is laterally slid into the first receiving space (11) with the pressing plate (13) engaging a top face of the first engaging plate (22) to secure the first terminal (2) relative to the seat (1). Then the second engaging plate (32) is laterally slid into the second receiving space (12) with opposite sides of the second engaging plate (32) received and secured in the receiving track (121), whereby the first terminal plate (21) and the second terminal plate (31) extend from a bottom face of the seat (1).

Figure 3:
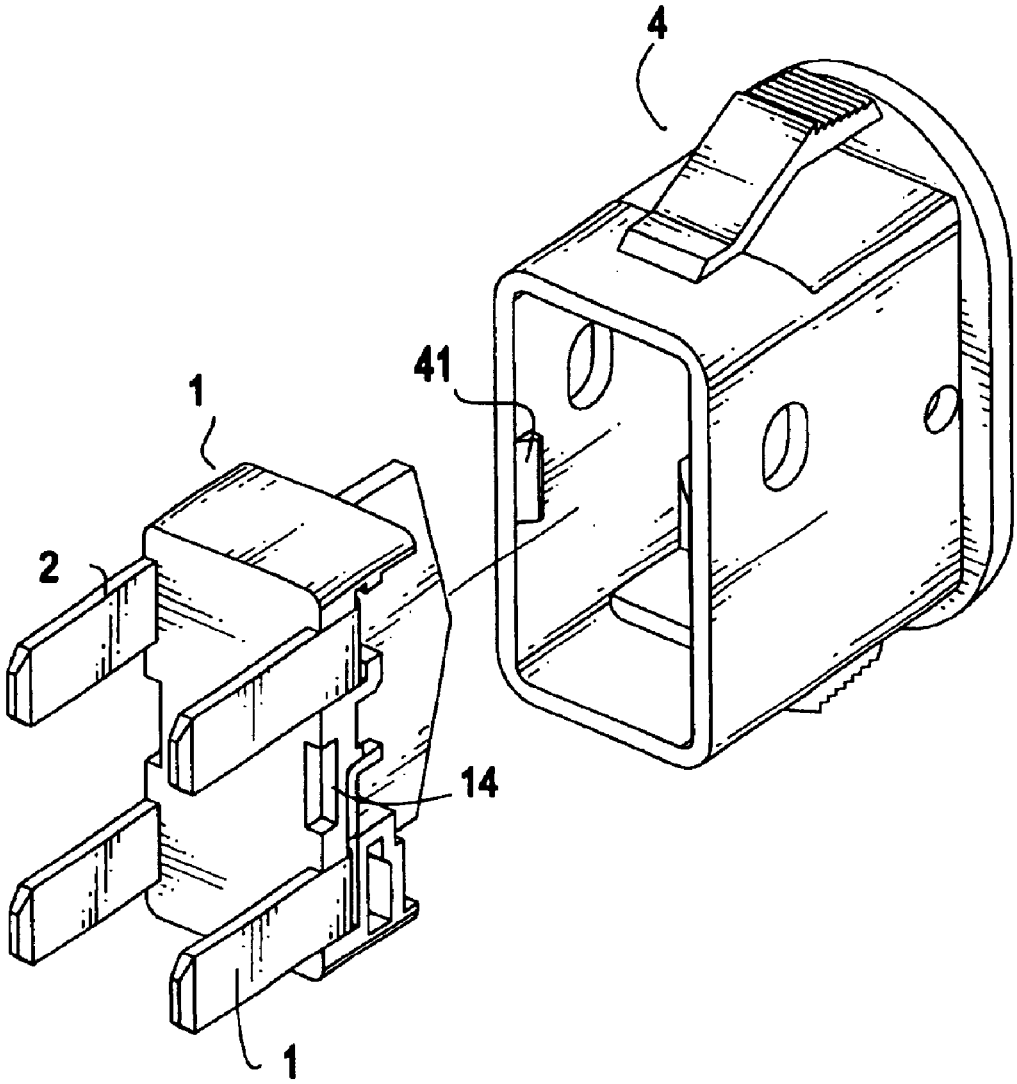
FIG. 3 is an exploded perspective view showing the assembly of the seat and the terminals, and a housing.
Figure 4:
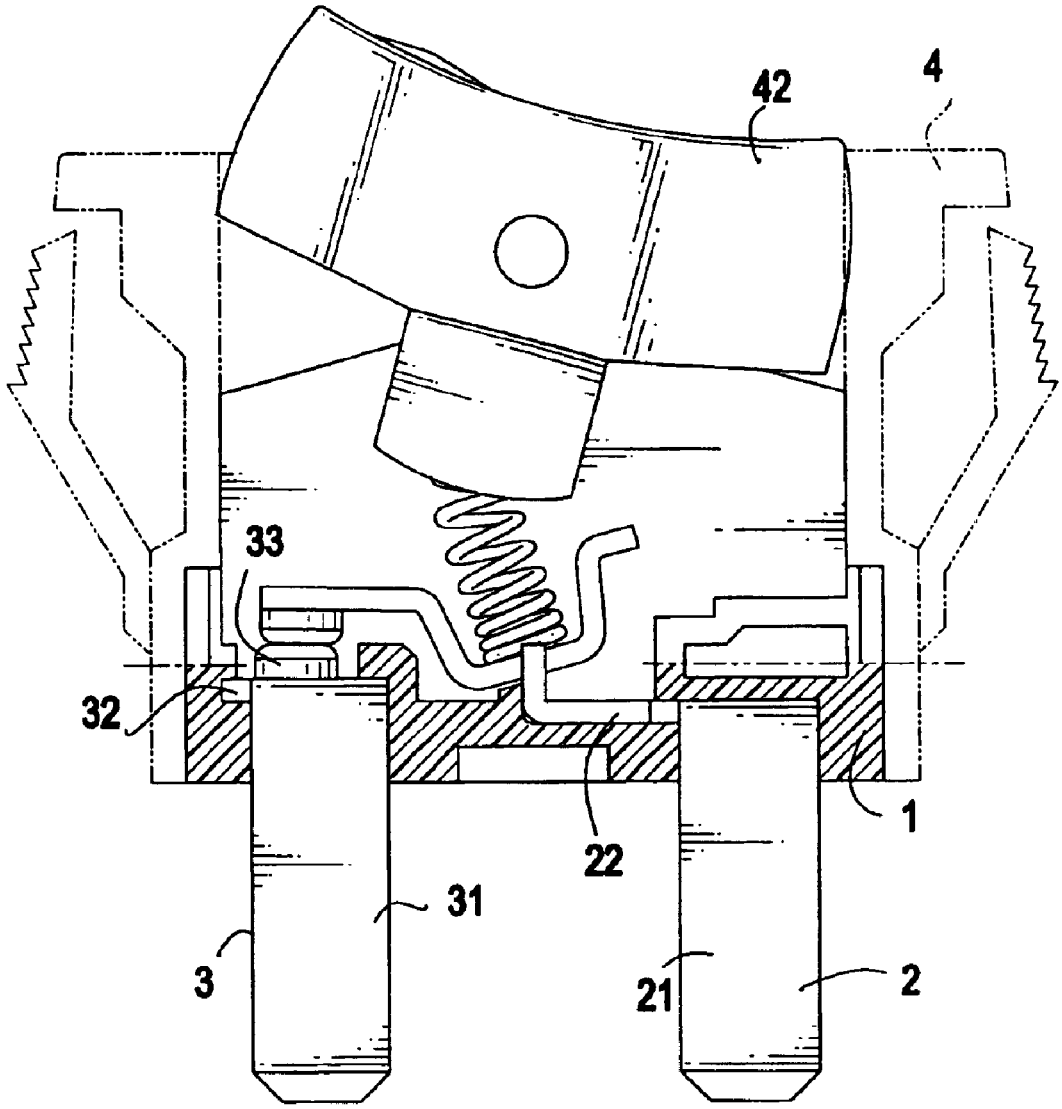
FIG. 4 is a schematic cross sectional view showing the application of the pushbutton switch of the present invention.
Figure 5:
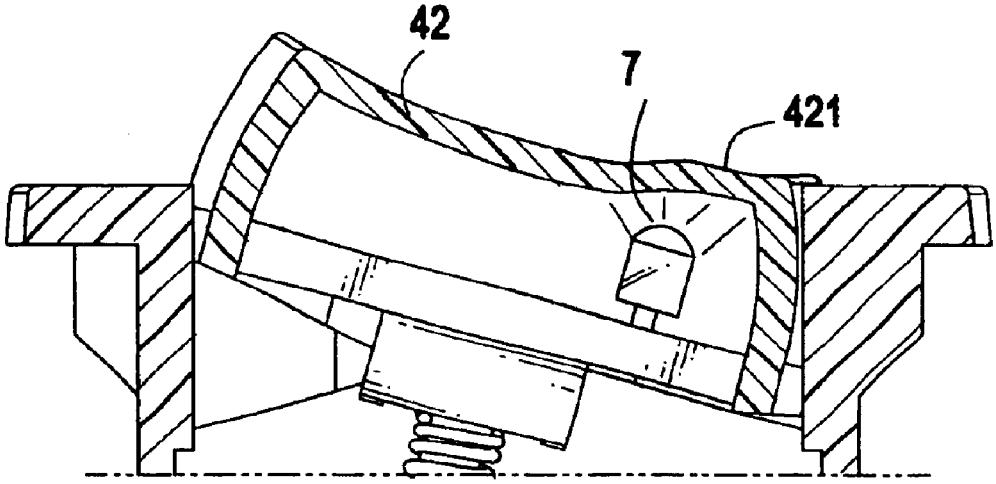
FIG. 5 is a schematic view showing the arrangement of the indicating lamp due to the configuration of the pushbutton.
Figure 7:
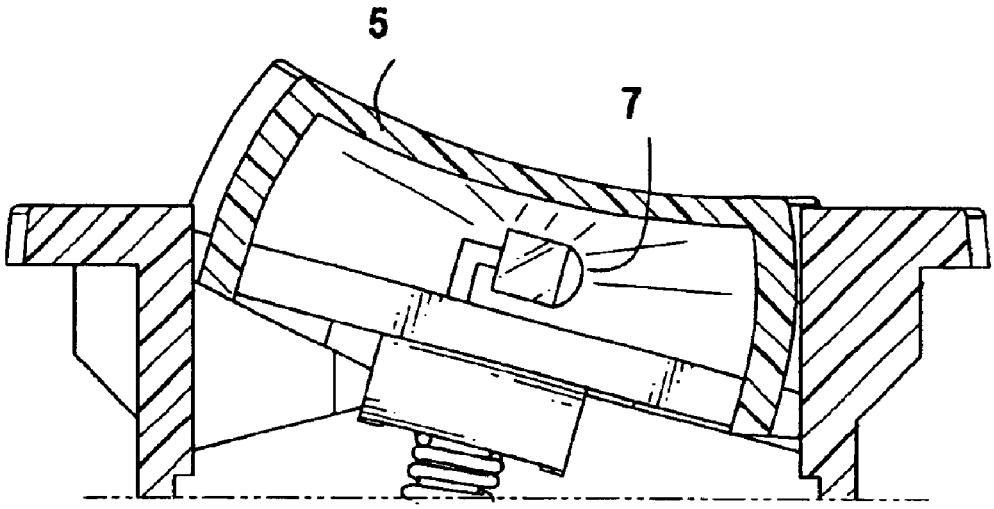
FIG.7 PRIOR ART
FIG. 7 is a schematic view showing the arrangement of the indicating lamp scatters the light from the indicating lamp.
Figure 6:
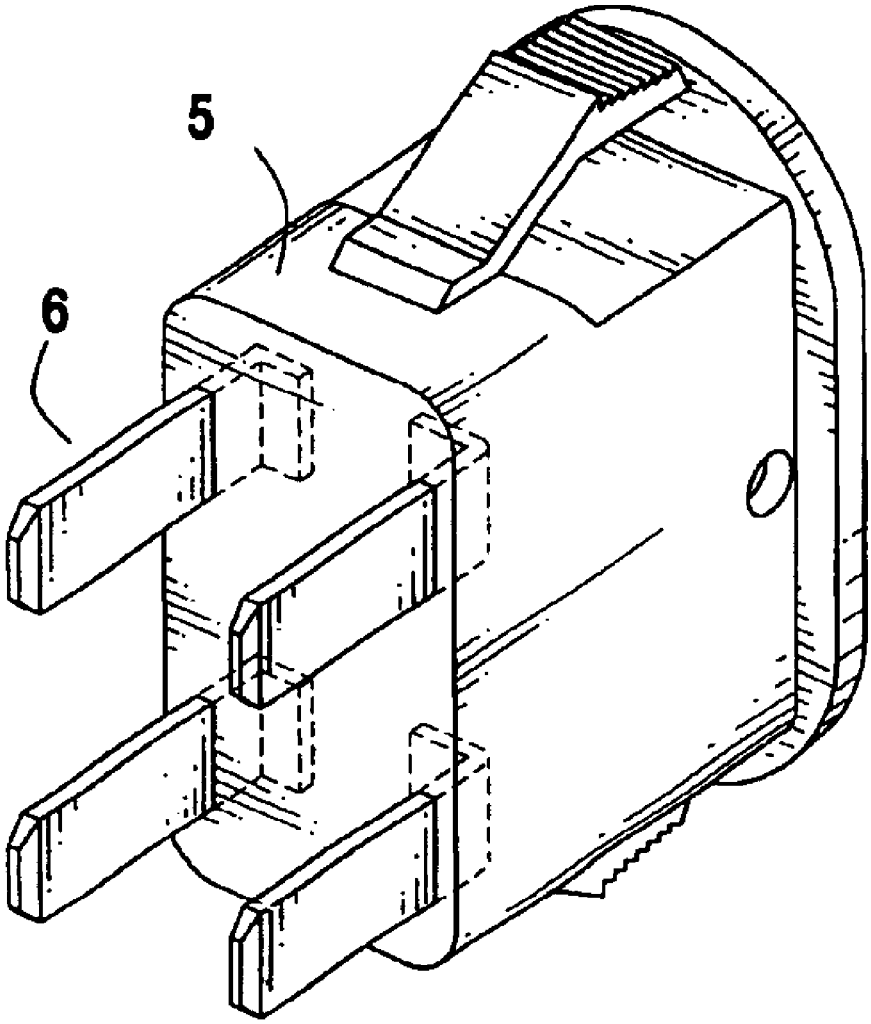
FIG.6 PRIOR ART
FIG. 6 is a perspective view of the conventional pushbutton switch.

A hollow housing (4), as shown in FIGS. 3 and 4, with an open end to correspond to the assembly of the seat (1) and the first and second terminals (2,3) and a pushbutton (42) is provided to receive therein the assembly of the seat (1) and the first and second terminals (2,3). The hollow housing (4) is provided with two wedges (41) respectively formed on one of two opposite inner faces of the hollow housing (4). In order to correspond to the two wedges (41) of the housing (4), the seat (1) has two cutouts (14) respectively defined in the bottom face of the seat (1). Thus after the two wedges (41) are respectively received in the corresponding cutout (14) of the seat (1), the assembly of the pushbutton switch of the present invention is assembled.

Furthermore, the switch (42) of the present invention has a window (421) formed and extending upward from a top face of the switch (42) and thus a concave space is defined under the window (421). Due to the concave space under the window (421), the indicating lamp is able to stand upright inside the pushbutton (42) and that the light from the indicating lamp is able to emit from the window (421). Thus, the observer is able to see clearly whether the pushbutton (42) is properly pressed.

From the foregoing description, it is noted that the assembly of the pushbutton switch of the present invention requires no auxiliary tool to force fit the terminals (2,3) into the housing (1) such that the intact of the housing (4) is retained. Furthermore, due to the deletion of the auxiliary tool, unnecessary manual labor is saved and the manufacture cost is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pushbutton switch comprising:

a hollow housing with a pushbutton pivotally mounted on a top face of the hollow housing and an open end;

a seat received in the hollow housing from the open end of the hollow housing, the seat having two first receiving spaces oppositely defined in opposites sides of the seat and two second receiving spaces oppositely defied in opposite sides of the seat;

two first terminals each having a first terminal plate extending from a bottom face of the seat and a first engaging plate orthogonally extending from a distal end of the first terminal plate and received in a corresponding one of the first receiving spaces laterally; and two second terminals each having a second terminal plate extending from the bottom face of the seat and a second engaging plate orthogonally extending from a distal end of the second terminal plate and received in a corresponding one of the second receiving spaces laterally.

2. The pushbutton switch as claimed in claim 1, wherein a pressing plate formed with the seat is engaged with a top face of the first engaging plate to secure the first terminal relative to the seat, a receiving track in communication with the second receiving space is defined in the seat to receive therein opposite sides of each of the second engaging plates.

3. The pushbutton switch as claimed in claim 1, wherein the hollow housing has two wedges formed on opposite inner faces of the housing and the seat has two cutouts oppositely defined in the bottom face of the seat to correspond to and receive therein the two wedges of the hollow housing so as to secure the seat inside the hollow housing.

4. The pushbutton switch as claimed in claim 2, wherein the hollow housing has two wedges formed on opposite inner faces of the housing and the seat has two cutouts oppositely defined in the bottom face of the seat to correspond to and receive therein the two wedges of the hollow housing so as to secure the seat inside the hollow housing.

* * * * *